US012435936B1

(12) United States Patent
Brooks-Mallory

(10) Patent No.: US 12,435,936 B1
(45) Date of Patent: Oct. 7, 2025

(54) METHODS, DEVICES, AND SYSTEMS FOR FACILITATING FIREARMS SAFETY

(71) Applicant: Betty Carol Brooks-Mallory, Pembroke Pines, FL (US)

(72) Inventor: Betty Carol Brooks-Mallory, Pembroke Pines, FL (US)

( * ) Notice: Subject to any disclaimer, the term of this patent is extended or adjusted under 35 U.S.C. 154(b) by 0 days.

(21) Appl. No.: 18/936,108

(22) Filed: Nov. 4, 2024

Related U.S. Application Data

(60) Provisional application No. 63/606,858, filed on Dec. 6, 2023.

(51) Int. Cl.
*F41A 17/06* (2006.01)

(52) U.S. Cl.
CPC ..... *F41A 17/066* (2013.01)

(58) Field of Classification Search
CPC ..... F41A 17/066; F41A 17/00; F41A 17/06
USPC ..... 42/70.011
See application file for complete search history.

(56) References Cited

U.S. PATENT DOCUMENTS 4,970,819 A * 11/1990 Mayhak ..... F41A 17/46 D22/104
5,502,915 A * 4/1996 Mendelsohn ..... F41A 17/066 42/70.11
6,301,815 B1 * 10/2001 Sliwa ..... F41A 17/066 42/70.11
6,345,461 B1 * 2/2002 Constant ..... F41A 17/04 42/70.11
6,360,469 B1 * 3/2002 Mikuta ..... F41G 1/345 42/70.11
6,415,542 B1 * 7/2002 Bates ..... F41A 17/06 42/70.11
7,339,456 B1 * 3/2008 Buckley ..... F41A 17/063 42/70.11
8,037,632 B2 10/2011 Pikielny
8,418,391 B2 * 4/2013 Kemmerer ..... F41A 17/066 42/70.05
8,881,443 B2 11/2014 Westwood et al.
9,057,571 B2 * 6/2015 Kemmerer ..... F41A 17/20
9,830,445 B1 * 11/2017 Machani ..... G06F 21/32
9,863,731 B1 * 1/2018 Alderman ..... F41A 19/58
10,591,237 B1 * 3/2020 Cannon ..... F41A 17/066
2002/0112390 A1 * 8/2002 Harling ..... H04K 3/20 42/70.11

(Continued)

FOREIGN PATENT DOCUMENTS

WO 2014130625 A1 8/2014

*Primary Examiner* — Joshua E Freeman
(74) *Attorney, Agent, or Firm* — John Rizvi; John Rizvi, P.A.—The Patent Professor ®

(57) ABSTRACT

Methods, systems, and devices for facilitating firearms safety are provided. A multi-factor authentication is performed to verify an identity of a user trying to access a secure firearm. Presence of a user contact with the secure firearm is detected, the secure firearm being in a locked state. Upon detecting the presence of the user contact with the firearm, the user is prompted to enter a passcode via a keypad on the secure firearm. Also, a biometric attribute of the user is obtained by a biometric sensor on the secure firearm. It is determined, if the user is an authorized user based on the passcode entered by the user and the biometric attribute of the user. In response to determining that the user is the authorized user, the secure firearm is unlocked.

20 Claims, 6 Drawing Sheets

(56) References Cited

U.S. PATENT DOCUMENTS

| | | | | |
|---|---|---|---|---|
| 2003/0115786 | A1* | 6/2003 | Klebes | F41A 17/066 42/70.11 |
| 2005/0066567 | A1* | 3/2005 | Newkirk | F41A 17/063 42/70.11 |
| 2013/0125441 | A1* | 5/2013 | Westwood | F41A 17/28 42/70.11 |
| 2014/0378088 | A1* | 12/2014 | Goel | H04W 4/029 455/404.2 |
| 2016/0195352 | A1* | 7/2016 | Pikielny | F41A 17/20 42/69.01 |
| 2017/0074611 | A1* | 3/2017 | Winiecki | H02J 7/00034 |
| 2018/0031344 | A1* | 2/2018 | Lyren | F41A 11/02 |
| 2018/0031345 | A1* | 2/2018 | Winiecki | F41A 17/46 |
| 2018/0259280 | A1* | 9/2018 | Martin | F41A 17/066 |
| 2021/0185138 | A1* | 6/2021 | Gant | H04L 63/0861 |
| 2023/0168056 | A1* | 6/2023 | Galie | F41A 17/06 42/69.03 |
| 2024/0384959 | A1* | 11/2024 | Allan | F41A 17/08 |
| 2025/0102255 | A1* | 3/2025 | Allan | F41A 17/54 |

* cited by examiner

METHODS, DEVICES, AND SYSTEMS FOR FACILITATING FIREARMS SAFETY

CROSS-REFERENCE TO RELATED APPLICATIONS

This application claims the benefit of the U.S. Provisional Patent Application Ser. No. 63/606,858 filed on Dec. 6, 2023, which is incorporated by reference herein in its entirety.

FIELD OF THE INVENTION

The present invention relates to firearms, and more particularly to devices, methods, and systems for enabling authorized access to secure firearms.

BACKGROUND OF THE INVENTION

Firearms safety has been a critical concern, with accidents, thefts, and unauthorized access of firearms leading to tragic outcomes. Existing solutions for preventing unauthorized access or accidental discharge of firearms aim to reduce accidents, theft, and misuse of the firearms. Safety measures, such as firearm safes, locks, or training, have been put in place to mitigate the accidents. However, the existing safety measures rely on physical keys or combinations, which may be vulnerable to theft, loss, or unauthorized use of the firearms.

Key-based locks may also be vulnerable to a user misplacing or losing the key, potentially leading to delays in accessing the firearm when needed. If the key falls into the wrong hands or is stolen, unauthorized individuals may gain access to the firearm, thus posing significant safety risks. Further, users may forget the combination to a firearm safe or lock. Thus, the manual unlocking mechanisms may slow down access to the firearm, potentially impeding users in emergency situations.

Further, in high-stress situations, users may struggle to remember or input complex combination codes or struggle with keys, further leading to potential delays in accessing the firearm. Some firearm safety solutions may require extensive user training to operate effectively, that may be a barrier to entry for firearm owners and may result in user errors or accidents. The safes and lockboxes may be susceptible to theft if not securely anchored or if the safe itself is easily removable. Experienced burglars may possess knowledge of how to bypass conventional locking mechanisms, making the firearms less secure against determined attackers.

The existing firearms safety solutions may also lack remote management capabilities, making it challenging for firearm owners to monitor or secure the firearms while being away from the firearm. Further, the existing firearm safety solutions may not integrate well with modern security systems, smart home technologies, or mobile applications, limiting the versatility and convenience.

Thus, there is a need of a solution to the above-noted problems. For example, there is a need for methods and systems that may allow authorized users to unlock the firearms quickly when necessary while maintaining robust security measures to prevent unauthorized access.

SUMMARY OF THE INVENTION

The present invention is directed to a secure firearm. The secure firearm comprises: a biometric sensor; a keypad; and a controller operatively coupled to the biometric sensor, and the keypad. The controller is configured to: detect presence of a user contact with the firearm, the firearm being in a locked mode; upon detecting the presence of the user contact with the firearm: prompt the user to enter a passcode via the keypad; identify the passcode entered by the user; obtain, from the biometric sensor, a biometric attribute of the user; determine, based on the passcode entered by the user and the biometric attribute of the user, if the user is an authorized user; and in response to determining that the user is the authorized user, unlocking the firearm.

In an aspect, the secure firearm may further comprise a contact sensor.

In an aspect, the contact sensor may be positioned on a grip, a trigger, a trigger guard, or a handle of secure firearm.

In an aspect, the controller may be further configured to: determine if the passcode entered by the user, is a valid passcode; and activate the biometric sensor to obtain the biometric attribute of the user, in response to a determination that the passcode entered by the user is the valid passcode.

In an aspect, the controller may be further configured to: determine if the biometric attribute of the user matches a biometric attribute of one or more authorized users, and in response to determining that the biometric attribute of the user matches with the biometric attribute of the one or more authorized users, prompt the user to enter the passcode.

The present invention is also directed to a method for facilitating firearms safety via a multi-factor authentication. The method comprises: detecting, by an electronic identification module positioned on a secure firearm, presence of a user contact with the secure firearm, the secure firearm being in a locked state; upon detecting the presence of the user contact with the secure firearm, prompting the user, by the electronic identification module, to enter a passcode via a keypad on the secure firearm; identifying, by the electronic identification module, the passcode entered by the user; obtaining, by the electronic identification module, a biometric attribute of the user by activating a biometric sensor on the secure firearm; determining, by the electronic identification module, if the user is an authorized user based on the passcode entered by the user and the biometric attribute of the user; and in response to determining that the user is the authorized user; enabling the user to access the secure firearm, wherein accessing the secure firearm enables the user to fire ammunition from the secure firearm by unlocking the secure firearm.

In an aspect, the electronic identification module may comprise a controller operatively coupled to the biometric sensor and the keypad.

In an aspect, the biometric sensor may be implemented as a biometric reader, or a biometric detector.

In an aspect, the electronic identification module may be positioned on at least one of: a body of the secure firearm, a handle of the secure firearm, a grip of the secure firearm, a top of a stock above the grip of the secure firearm, a trigger of the secure firearm, a barrel of the secure firearm, or a magazine housing of the secure firearm.

In an aspect, the biometric attribute of the user may comprise: a fingerprint, a palm print, a retinal scan, an iris scan, a voice recognition, or a face recognition.

In an aspect, the method may further comprise: registering, by the electronic identification module, the biometric attributes of one or more users in a database, wherein the registering enables the one or more users to be authorized users to access the secure firearm.

In an aspect, the method may further comprise: storing, by the electronic identification module, the biometric attributes of the one or more users in a database.

In an aspect, the method may further comprise: in response to determining that the user is not the authorized user, blocking the user to access the secure firearm, wherein blocking the user to access the secure firearm prevents the user to fire ammunition from the firearm.

In an aspect, the method may further comprise: obtaining, by the electronic identification module, a one-time password entered by the user one a user device.

In an aspect, determining if the user is the authorized user comprises determining further based on the one-time password entered by the user.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. The term "comprising" can also encompass the terms "consisting essentially of" and "consisting of". Furthermore, there is no intention to be bound by any expressed or implied theory presented in the preceding technical field, background, brief summary or the following detailed description. It is also to be understood that the specific methods, devices, and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed towards methods, systems, and devices for facilitating firearms safety via a multi-factor authentication. Presence of a user contact with a secure firearm is detected. The user is prompted to enter a passcode via a keypad. Further, a biometric attribute of the user is obtained. Upon determining that the user is an authorized user based on the passcode entered by the user and the biometric attribute of the user, the user is enabled to access the secure firearm, wherein accessing the secure firearm enables the user to fire ammunition from the firearm.

The method and various operations involved in the method flow are performed by a controller (such as controller 204, or 308, as shown in some of the drawings) in an electronic identification module, such as electronic identification module 205, or 310 as shown in some of the drawings, positioned on the secure firearm. Further, the secure firearm may be implemented as 300, or 600 as shown in some of the drawings.

Figure 1:
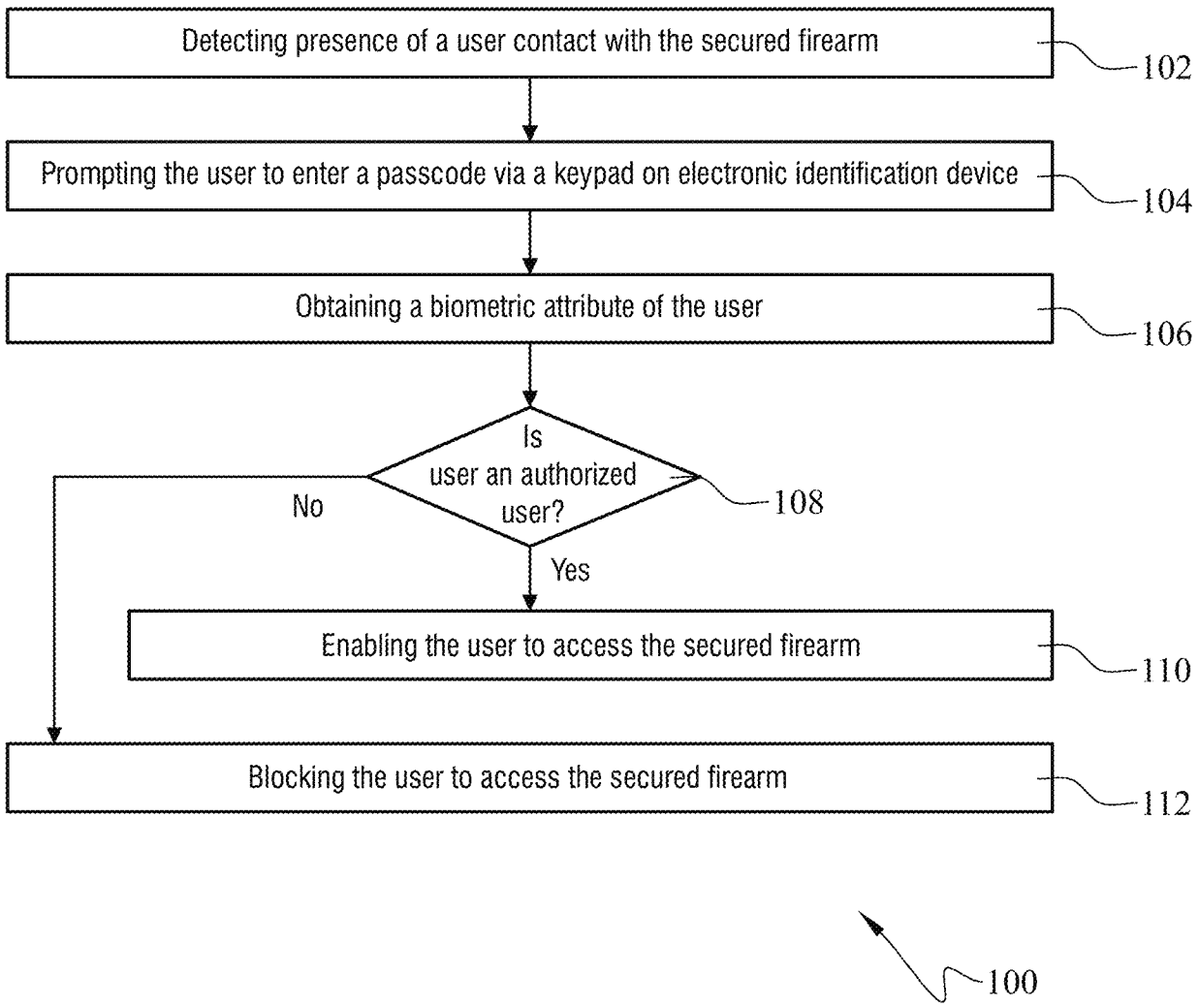
FIG. 1 shows a flowchart of an example firearm security method, in accordance with some embodiments of the present disclosure.

Referring initially to FIG. 1, which shows a flowchart of an example method, in accordance with some embodiments of the present disclosure. The flowchart comprises a method 100 that when performed, facilitates firearms security. The method may be performed or controlled by the controller 204, or 308 in the electronic identification module, such as the electronic identification module 205, or 310 as shown in some of the drawings, positioned on a secure firearm.

Figure 3:
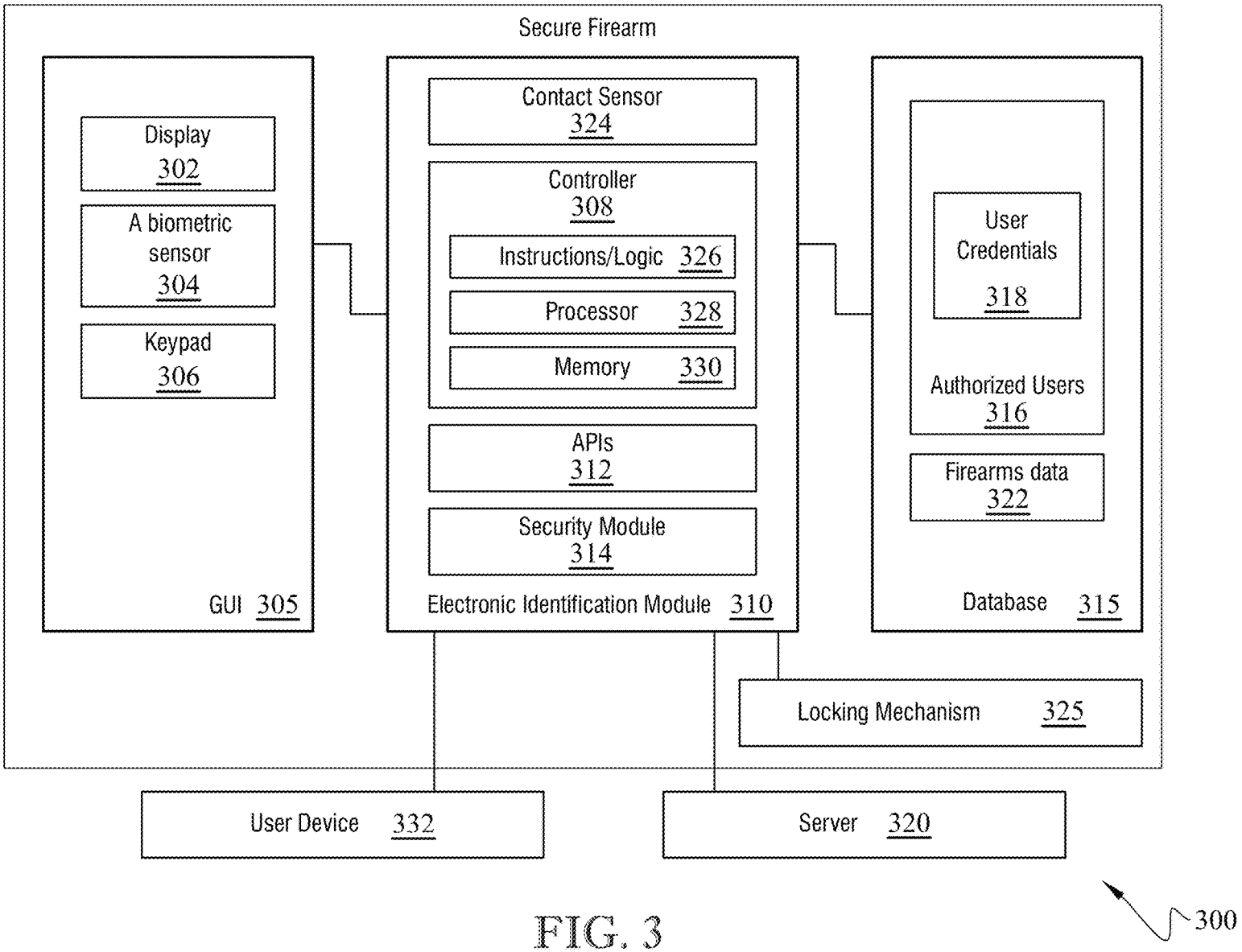
FIG. 3 shows an exemplary block diagram of a secure firearm via which certain features of the method of the present disclosure can be implemented, in accordance with some embodiments of the present disclosure.

The electronic identification module 205, or 310 may comprise a contact sensor (such as contact sensor 202, or 324, as shown in some of the drawings), the controller 204, or 308, and a security module (such as security module 206, or 314, as shown in some of the drawings). The secure firearm 300, or 600 may comprise a biometric sensor, and a keypad (such as biometric sensor 304, and keypad 306, as shown in FIG. 3). The electronic identification module 205, or 310 may communicate with a server, such as server 220, or 320, as shown in some of the drawings, over a network interface. The server 220, or 320 may refer to a computer or system that provides services or resources to other computers or users on a network. The server 220, or 320 may also be one or more of a host, a node, a machine, a system, a computer, a platform, a backend, a web portal, a web application, or a computer application. The electronic identification module 205, or 310 may be implemented using hardware, software, or a combination of hardware and software.

The method 100 begins at block 102, where presence of a user contact with the secure firearm 300, or 600 is detected by the electronic identification module 205, or 310, positioned on the secure firearm. A multi-factor authentication is performed in order to ensure that only verified and authorized users may have an access to the secure firearm 300, or 600. The multi-factor authentication may enhance the security of firearms, thereby preventing unauthorized access or accidental discharge of the firearms in order to reduce accidents, theft, or misuse of the firearms. Upon acquiring the secure firearm 300, or 600, one or more users, to be authorized to access the secure firearm 300, or 600, may be registered within a database associated with the electronic identification module 205, or 310. The registered one or more users are authorized users to access the secure firearm 300, or 600. The one or more users may provide a username, a passcode, and a biometric attribute for registration and may later use the passcode and the biometric attribute for accessing the secure firearm 300, or 600, via the electronic identification module 205, or 310.

Figure 2:
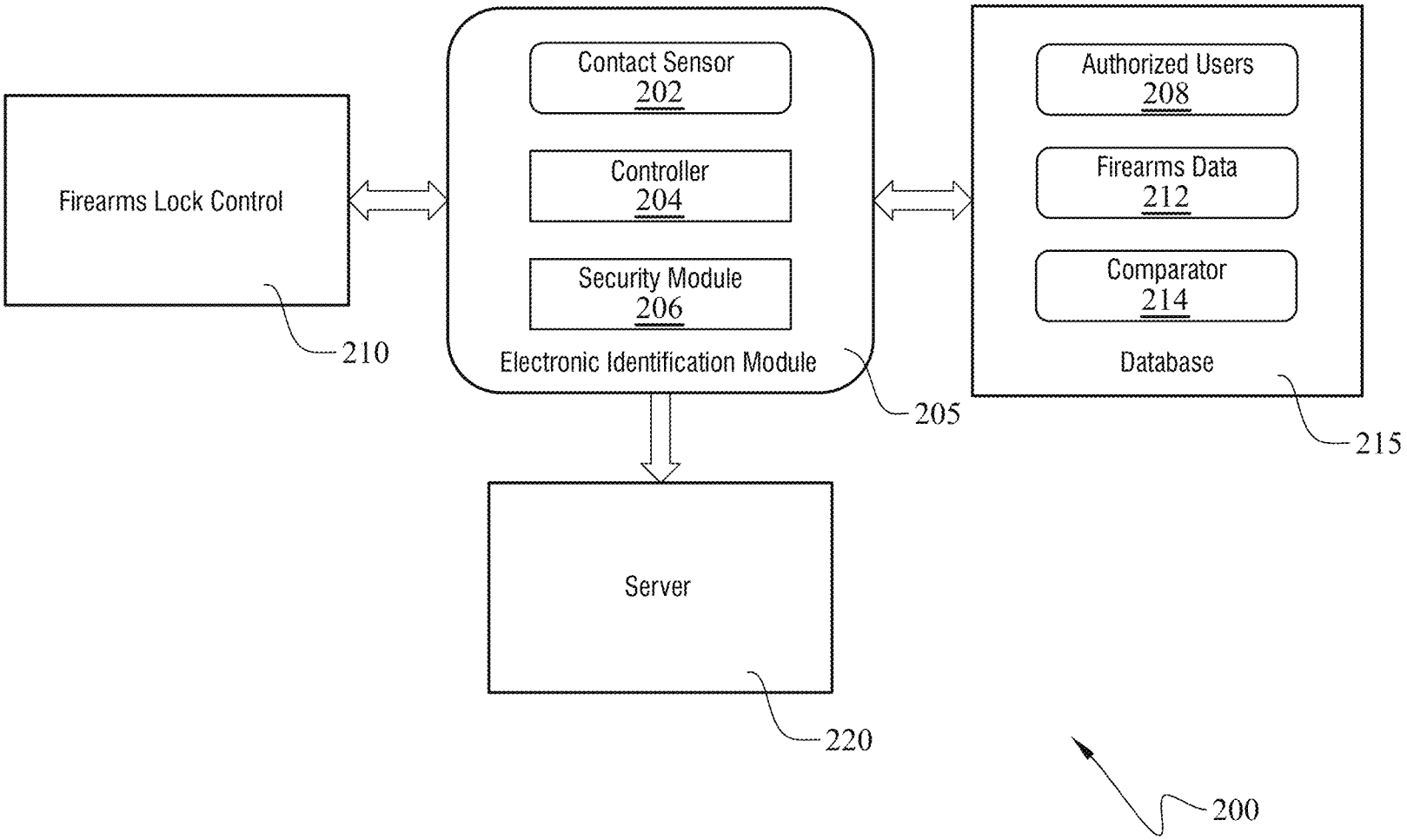
FIG. 2 shows an exemplary block diagram representation of a system within which certain features of the present disclosure can be implemented, in accordance with some embodiments of the present disclosure.

According to some embodiments of the present invention, the database associated with the electronic identification module 205, or 310 may be implemented as database 215, or 315 (shown in FIG. 2, or FIG. 3 respectively). The database 215, or 315 may store user credentials 318 such as the username, the passcode, or the biometric attribute of the one or more authorized users in order to verify the identity of the one or more users trying to access the secure firearm 300, or 600.

In an aspect, the database 215, or 315 may be implemented on the server 220, or 320 as a centralized database, where the database 215, or 315 may comprise user credentials of the one or more users authorized to access one or more secure firearms.

Upon detecting the presence of the user contact with the secure firearm 300, or 600, the user is prompted, by the electronic identification module 205, or 310 positioned on the secure firearm, to enter a passcode via the keypad 306 on the secure firearm 300, or 600 at block 104. Further, a biometric attribute of the user is obtained, by the electronic identification module 205, or 310, via the biometric sensor 304 on the secure firearm 300, or 600, at block 106.

In some embodiments, block 106 may be performed prior to block 104.

At block 108, it is determined if the user is an authorized user based on the passcode entered by the user and the biometric attribute of the user. The passcode entered by the user may be compared to the passcode in the database 215, or 315, as entered by the user upon registration and as stored within the database 215, or 315. Further, the obtained biometric attribute of the user is also compared to a biometric attribute of the one or more authorized users in the database 215, or 315. If the passcode entered by the user is a valid passcode, and the biometric attribute of the user matches a biometric attribute of one or more authorized users registered in the database 215, or 315, the user is determined to be an authorized user.

In an aspect of the present invention, only upon determining that the passcode entered by the user is a valid passcode, the biometric sensor 304 on the secure firearm 300, or 600 may be activated to obtain the biometric attribute of the user. The biometric attribute of the user is then compared to a biometric attribute of the one or more authorized users stored in the database 215, or 315, thereby verifying the identity of the user trying to access the secure firearm 300, or 600. Further, in response to determining that the passcode entered by the user is not the valid passcode, the biometric sensor 304 may not be activated.

In another aspect of the present invention, the biometric attribute of the user is compared to a biometric attribute of the one or more authorized users stored in the database 215, or 315, and in response to determining that the biometric attribute of the user matches with a biometric attribute of the one or more authorized users, the user is only then prompted to enter the passcode, via the keypad 306 on the secure firearm 300, or 600. The passcode entered by the user is then compared to the passcode stored in the database 215, or 315, thereby verifying the identity of the user trying to access the secure firearm 300, or 600. Further, in response to determining that the biometric attribute of the user does not match with a biometric attribute of the one or more authorized users, the user may not be prompted to enter the passcode.

According to some embodiments of the present invention, the multi-factor authentication to verify the identity of the user tying to access the secure firearm may also comprise sending a one-time-password to a user device associated with the user. The user device may be any electronic device, such as but not limited to, a mobile device, a smartphone, a laptop, a tablet, a smart watch, or the like. The user may enter the one-time-password via the electronic identification module 205, or 310 positioned on the secure firearm. In an aspect, the user may enter the one-time-password on the user device, via a mobile application installed on the user device. Further, the server 220, or 320 may retrieve the one-time-password entered by the user on the user device in order to verify the identity of the user. The verification response may be provided by the server 220, or 320 to the electronic identification module 205, or 310 over the network interface.

Thus, in addition to the passcode and the biometric attribute of the user, the electronic identification module 205, or 310 may also utilize the one-time-password entered by the user to verify the identity of the user trying to access the secure firearm.

Further, according to some embodiments of the present invention, the secure firearm 300, or 600 may comprise a locking mechanism (such as firearms lock control 210, or locking mechanism 325 as shown in some of the drawings) to keep the secure firearm 300, or 600 in a locked state or in an unlocked state. In the locked state, the secure firearm 300, or 600 is rendered inoperable and inaccessible for use in order to prevent the secure firearm 300, or 600 from being discharged or accessed by unauthorized individuals. In the unlocked state, the secure firearm 300, or 600 may be operable and may be accessed by an authorized individual upon verification of the identity of the authorized individual. Upon accessing the secure firearm 300, or 600, the authorized individual may fire ammunition from the firearm.

The locking mechanism 210, or 325 may be equipped with one or more of a mechanical lock, a smart lock, or an electronic lock. The mechanical lock may comprise a button, a switch, a spring, a latch, a magnet, or other mechanical components. The smart lock may be operated remotely via a mobile device associated with the user. The electronic lock may comprise a biometric sensor, a keypad, or like.

In response to determining that the user is an authorized user, the user is enabled to access the secure firearm 300, or 600 at block 110, wherein accessing the secure firearm 300, or 600 may enable the user to fire ammunition from the firearm. In an aspect, in response to determining that the user is an authorized user, the secure firearm 300, or 600 may be switched from a locked state to an unlocked state.

However, if the user is not an authorized user, the user may be blocked to access the secure firearm 300, or 600 at block 112. Blocking the user to access the secure firearm 300, or 600 may prevent the user to fire ammunition from the firearm. In an aspect, in response to determining that the user is not an authorized user, the secure firearm 300, or 600 may not be switched from a locked state to an unlocked state, and may be kept in the locked state.

Further, in response to determining that the passcode entered by the user is not the valid passcode, the biometric sensor 304 on the secure firearm 300, or 600 may not be activated. If the passcode is determined to be invalid, the secure firearm 300, or 600 is kept in the locked state, and the biometric sensor 304 is not activated (sleep mode). Similarly, if the biometric attribute of the user is obtained prior to the passcode, and if the biometric attribute of the user does not match with a biometric attribute of one or more authorized users, then the keypad entry is not prompted and the secure firearm 300, or 600 is kept in the locked state.

In an aspect of the present invention, in response to a plurality of unsuccessful attempts to access the secure firearm 300, or 600, a notification may be sent to the secure firearm owner or a public safety officer such as an emergency responder, police, or fire control. The notification may be indicative of someone unauthorized is attempting to access the secure firearm 300, or 600. The notification may also comprise other details such as details of the secure firearm (type, manufacturer, etc.), the secure firearm owner, or location of the secure firearm 300, or 600. The location of the secure firearm 300, or 600 may also be tracked via a GPS capability enabled in the secure firearm 300, or 600.

According to some embodiments of the present invention, the biometric sensor 304 may also be implemented as a biometric reader, or a biometric detector. Further, the electronic identification module 205, or 310 may be positioned on at least one of: a body of the secure firearm, a handle of the secure firearm, a grip of the secure firearm, a top of a stock above the grip of the secure firearm, a trigger of the secure firearm, a barrel of the secure firearm, or a magazine housing of the secure firearm.

Further, the biometric attribute of the user may comprise: a fingerprint of the user, a palm print of the user, a retinal scan of the user, an iris scan of the user, a voice recognition of the user, or a face recognition of the user.

FIG. 2 shows an exemplary block diagram representation of a system 200 within which certain features of the present disclosure may be implemented, in accordance with some embodiments of the present disclosure. The firearms safety system may involve a seamless interaction between multiple components of the system 200 such as, an electronic identification module 205, a firearms lock control 210, a database 215 and a server 220.

When a user tries to access a secure firearm, the electronic identification module 205, positioned on the secure firearm, may determine the user contact via a contact sensor 202. The contact sensor 202 may detect physical presence of the user attempting to access the secure firearm. The contact sensor 202 may also be positioned on the secure firearm, such as a grip, a trigger, a trigger guard, or a handle of the secure firearm. Upon detecting the user contact, the contact sensor 202 may trigger an authentication process by signaling the electronic identification module 205 to initiate user verification in order to ensure that the user is authorized to access the secure firearm.

In order to verify the user authorization, the user is prompted, by the electronic identification module 205, to enter a passcode, via a keypad on the secure firearm. Further, a biometric attribute of the user is also obtained via a biometric sensor 304 on the secure firearm. The user is authorized based on the passcode entered by the user and the biometric attribute of the user. The biometric sensor 304 may obtain one or more biometric attributes of the user, such as, but not limited to, fingerprints, palm prints, retinal scans, iris scan, voice recognition, or facial features.

One or more users may be initially registered, within the database 215 associated with the secure firearm, by enabling the one or more users to enter user credentials, a passcode, and a biometric attribute. The registered one or more users in the database 215 are authorized to access the secure firearm. The user credentials, the passcode, and the biometric attribute of the one or more authorized users may be stored in the database 215 as authorized users 208.

In an aspect of the present invention, the database 215 may comprise credentials of one or more users authorized to access one or more secure firearms. The database 215 may be associated with one secure firearm or may be associated with a plurality of secure firearms. If the database 215 is associated with the one secure firearm, the database 215 may be implemented in the secure firearm only as a local database. The local database may be specific to the secure firearm only. The database 215 implemented as the local database may store essential information related to authorized users, access logs, or other security-related data directly on the secure firearm.

In an aspect of the present invention, the database 215 may be associated with the plurality of secure firearms, and may be implemented as a cloud database on the server 220 and may be managed by a manufacturer or seller of the plurality of the secure firearms. The cloud database may store data related to the plurality of the firearms. The cloud database may also offer a centralized data storage and management of the plurality of the firearms. The cloud database may further enable the one or more authorized users to access, monitor, or control the plurality of the secure firearms remotely. The cloud database may further enable the manufacturer or the seller of the plurality of the secure firearms to remotely provide software updates, security patches, or enhancements to the one or more secure firearms of the plurality of the secure firearms. The manufacturer or the seller of the plurality of the secure firearms may also receive real-time notifications, may control remote locking/unlocking based on the access of the secure firearms, or may audit the access of the plurality of the secure firearms by one or more authorized users.

Identification information of the one or more secure firearms may also be stored in the database 215 as firearms data 212 (also referred to as firearms data 322 stored in the database 315 in FIG. 3). The firearms data 212 may comprise identification information of the one or more secure firearms, such as the make, model, serial number, caliber, or any other relevant details that may uniquely identify the one or more secure firearms. The firearms data 212 may also be utilized for tracking and managing the one or more secure firearms by a security module 206 in the electronic identification module 205. Further, the firearms data 212 may also provide a record of ownership of the one or more secure firearms to the security module 206. The security module 206 may further prevent unauthorized access of the one or more secure firearms, thereby ensuring the one or more secure firearms may be used responsibly.

The database 215 may be regularly updated to reflect changes in the ownership, transfers, sales, or other relevant events related to the one or more secure firearms. The database 215 may maintain accurate records and may ensure that the one or more secure firearms data 212, 312 is up to date.

Further, the passcode entered by the user, via the keypad, may be compared by a comparator 214 to the initially registered passcode in the database 215 in order to verify the identity of the user trying to access the secure firearm. The comparator 214 may be implemented as hardware, software, or a combination of hardware and software. The comparator 214 may also be implemented as a dedicated integrated circuit (IC) or a microcontroller. The comparator 214 may comprise a processor to execute an instruction to compare the passcode entered by the user to the registered passcode in the database 215. The comparator 214 may also be implemented as a part of the electronic identification module 205.

In addition, the biometric attribute of the user, obtained via the biometric sensor 304, may also be compared by the comparator 214 in the database 215 to the initially registered one or more biometric attributes of the one or more authorized users to access the secure firearm. It is determined whether or not, the user is authorized to access the secure firearm based on the passcode obtained via the keypad and the biometric attribute of the user obtained via the biometric sensor. In response to determining that the user is the authorized user, the electronic identification module 205 may provide a signal to the firearms lock control 210 to switch the state of the secure firearm from a locked state to an unlocked state.

In an aspect of the present invention, in response to determining that the passcode entered by the user is a valid passcode, the biometric sensor on the secure firearm may then be activated to obtain the biometric attribute of the user. The biometric attribute of the user is then compared to a biometric attribute of the one or more authorized users stored in the database 215, thereby verifying the identity of the user trying to access the secure firearm.

In a further aspect of the present invention, the biometric attribute of the user, obtained via the biometric sensor, is compared to the biometric attribute of the one or more authorized users in the database 215, and in response to determining that the biometric attribute of the user matches with the biometric attribute of the one or more authorized users, the user is then prompted to enter the passcode, via the keypad. The passcode entered by the user is then compared to the passcode stored in the database 215, thereby verifying the identity of the user trying to access the secure firearm.

In an aspect of the present invention, the electronic identification module 205 positioned on the secure firearm may communicate with the server 220 via a network interface in order to verify the identity of the user trying to access the secure firearm. Further, in an aspect, the server 220 may comprise the database 215 storing the authorized users 208, the firearms data 212, or the comparator 214. The electronic identification module 205 may establish a secure connection with the server 220 using encryption protocols (e.g., SSL/TLS) to protect the data transmitted between the secure firearm and the server 220 from interception or tampering. The electronic identification module 205 may send a request to the server 220 comprising relevant firearm data and the user data, such as, the passcode entered by the user, the biometric attribute of the user, the firearm information, or like.

Various operations of the electronic identification module 205 are performed by a controller 204 in the electronic identification module 205. The controller 204 may comprise a processor to execute instructions that drive the functionality of the systems and methods of the present invention. Further, the controller 204 may also comprise a memory to store the instructions to be executed by the processor.

In an aspect of the present invention, the server 220 may be implemented as a part of the controller 204 in the secure firearm. The server 220 may perform comparison of the data sent by the electronic identification module 205 to the data stored in the database 215. The database 215 may be a centralized database of the one or more authorized users associated with the one or more firearms. Based on the comparison, the server 220 may send an authorization response back to the electronic identification module 205. The authorization response may comprise the user being an authorized user to access the secure firearm or the user being an unauthorized user to access the secure firearm.

If the user is an authorized user, the electronic identification module 205 may indicate the firearms lock control 210 to unlock the secure firearm, thereby allowing the user to access the secure firearm. Further, the server 220 may also record the secure firearm access events, send alerts or notifications to a user device associated with the user, or may also update the status of the access of the secure firearm. Access logs and event data may be synchronized with the server 220 for auditing and monitoring purposes. The communication between the electronic identification module 205 and the server 220 may allow real-time updates, remote management, and the ability to revoke access in case of emergencies or changes in user status.

Further, the server 220 may refer to a computer or system that provides services or resources to other computers or users on a network. Moreover, the electronic identification module 205 may be implemented using cloud computing. In some implementations, one or more functions of the electronic identification module 205 may be performed by one or more components of a cloud server. In some embodiments, the electronic identification module 205 may be an artificial intelligence based or an AI-based engine. In some embodiments, the AI-based engine may comprise or may implement a trained machine learning (ML) model.

Various components of the system 200 may interact with each other over a network interface (not shown in the figure) that may ensure seamless and secure data exchange among the components. The network interface may employ standard data transmission protocols, such as HTTPS (Hypertext Transfer Protocol Secure) for secure communication over internet. The data transmitted over the network interface may be encrypted using industry-standard encryption algorithms. Application Programming Interfaces (APIs) may also serve as communication endpoints that may enable the components of the system 200 to interact with each other. Secure user authentication processes, comprising token-based authentication or OAuth (Open Authorization), may also be employed to verify the identity of the users and authorized components. Further, integration with external services, such as payment gateways or third-party APIs may also be facilitated through secure communication channels.

The network interface may manage one or more communication protocols governing the format and structure of data exchange between the components. Further, the network interface may employ encryption and security measures to protect sensitive information. The network interface may also manage error handling and redundancy mechanisms. The network interface may utilize various communication channels such as, local area networks (LAN), wide area networks (WAN), or the internet.

Further, in an aspect of the present invention, the user may utilize a mobile application installed on a user device associated with the user for managing authorization of the one or more users associated with the one or more secure firearms. The mobile application may enable seamless integration of various components and functions on the user device. The multi-factor authentication may also be performed, by the electronic identification module 205, via the mobile application installed on the user device, to verify the identity of a user trying to access the secure firearm.

According to an embodiment of the present invention, as a part of the multi-factor authentication to verify the identity of the user tying to access the secure firearm, a one-time-password (OTP) may be sent to the user device associated with the user. The user device may be any electronic device, such as but not limited to, a mobile device, a smartphone, a laptop, a tablet, a wearable device such as a smart watch, or the like. The user may enter the one-time-password via the mobile application on the user device. The one-time-password may be retrieved by the server 220, thereby providing an indication to the electronic identification module 205 positioned on the secure firearm, to enable or block the user to access the secure firearm as per verification of the one-time-password received by the server 220. Thus, in addition to the passcode and the biometric attribute of the user, the electronic identification module 205 may also utilize the one-time-password entered by the user to verify the identity of the user trying to access the secure firearm, thereby ensuring the multi-factor authentication.

FIG. 3 shows an exemplary block diagram of a secure firearm 300 within which certain features of the invention of the present disclosure can be implemented, in accordance with some embodiments of the present disclosure. The secure firearm 300 may comprise various function blocks that may be involved in the functioning of the system of the present invention. The secure firearm 300 may comprise a graphical user interface (GUI) 305, an electronic identification module 310, a database 315, and a locking mechanism 325. Further, the secure firearm may interact with a user device 332, and a server 320 over a communication network.

The GUI 305 may encompass the visual components, user interface elements, and interactive elements that constitute the user-facing part of the system. The GUI 305 may comprise a display 302, a biometric sensor 304, a keypad 306, or other graphical assets used to present the user interface of the secure firearm 300 to the users. The users may interact with various elements on the GUI 305, such as buttons, checkboxes, or biometric to access the secure firearm 300.

In an aspect, the biometric sensor 304 may be a fingerprint reader. In another aspect, the biometric sensor 304 may be a palm reader. In another aspect, the biometric sensor 304 may be a retinal scanner. Further, in another aspect, the biometric sensor 304 may be an iris scanner. In another aspect, the biometric sensor 304 may be a voice recognizer. Furthermore, in another aspect, the biometric sensor 304 may comprise facial recognition.

The electronic identification module 310 may comprise a contact sensor 324, a controller 308, APIs 312, and a security module 314. The controller 308 is operatively coupled with the biometric sensor 304, and the keypad 306. The controller 308 is being configured to: detect presence of a user contact with the secure firearm 300 in a locked state, prompt the user to enter a passcode via the keypad 306 upon detecting the presence of the user contact with the secure firearm 300, identify the passcode entered by the user, obtain a biometric attribute of the user via the biometric sensor 304, determine if the user is an authorized user based on the passcode entered by the user and the biometric attribute of the user, and unlocking the secure firearm 300 in response to determining that the user is an authorized user.

Further, the controller 308 may comprise instructions/logic 326 comprising the core programming code and algorithms that drive the functionality of the systems and methods of the present invention, for example the method 100 or the system 200. The instructions/logic 326 may be responsible for various aspects of system operation, including data processing, encoding, validation, authentication, manipulation, and storage. The instructions/logic 326 may determine how data is received, validated, encoded, transformed, or stored within the database 315 or other storage systems. Additionally, the instructions/logic 326 may also define logic flow of the system, controlling the sequence of operations, decision-making processes, or error handling mechanisms.

The instructions/logic 326 is executed by a processor 328 in the controller 308 to perform or control performance of operations of the present disclosure. The controller 308 may also comprise a memory 330 to store the instructions to be executed by the processor 328. The instructions may comprise instructions to cause the processor 328 to perform or control performance of operations of the example method 100.

Furthermore, the instructions/logic 326 may also enable the system to interact with external resources, such as APIs (Application Programming Interfaces) or services that may facilitate the exchange of data, enabling communication and integration with other systems or platforms. Moreover, the instructions/logic 326 may further enable the system to respond to user interactions and inputs by defining how user actions are processed, triggering appropriate responses, updates, or changes in the state of the system. The instructions/logic 326 may handle user requests, validate input data, perform required computations, and may generate responses or feedback to provide a seamless and interactive user experience.

The contact sensor 324 in the electronic identification module 310 may determine presence of a user contact with the secure firearm 300 and may send a request to the controller 308 to verify the identity of the user trying to access the secure firearm 300. The controller 308 is configured to activate the biometric sensor 304 and the keypad 306 to obtain a biometric attribute of the user and a passcode to be entered by the user. The biometric attribute obtained from the user, via the biometric sensor 304, may be compared to a biometric attribute of one or more authorized users 316 in the database 315. Also, the passcode entered by the user, via the keypad 306, may be compared to a stored passcode in the database 315. If the passcode entered by the user is valid and the biometric attribute of the user matches a biometric attribute of one or more authorized users 316 in the database 315, the user is determined to be an authorized user.

In an aspect of the present invention, the controller 308 may be further configured to determine if the passcode entered by the user, via the keypad 306, is a valid passcode; and then activate the biometric sensor 304 to obtain the biometric attribute of the user, in response to determining that the passcode entered by the user is a valid passcode.

In another aspect of the present invention, the controller 308 may be configured to determine if the biometric attribute of the user, obtained via the biometric sensor 304, matches a biometric attribute of one or more authorized users, and in response to a determination that the biometric attribute of the user matches with the biometric attribute of the one or more authorized users, the user is prompted to enter the passcode, via the keypad 306.

In addition to the multi-factor authentication comprising validation of the biometric attribute of the user and the passcode entered by the user, the controller 308 may further verify the identity of the user via a one-time-password to be sent to the user device 332 associated with the user. The controller 308 may also communicate with the server 320 for accessing the database 315, when the database 315 is implemented as a centralized database. The controller 308 may establish a secure connection with the server 320, using encryption protocols to protect data in transit.

In an aspect of the present invention, the one-time-password (OTP) may be sent to the user device 332 associated with the user via the server 320. The user device 332 may be any electronic device, such as but not limited to, a mobile device, a smartphone, a laptop, a tablet, a smart watch, or the like. The user may enter the received one-time-password via a mobile application installed on the user device 332. The one-time-password may be retrieved by the server 320, thereby providing an indication to the electronic identification module 310 positioned on the secure firearm, to enable or block the user to access the secure firearm as per verification of the one-time-password received from the user device 332. Thus, in addition to the passcode and the biometric attribute of the user, the electronic identification module 310 may also utilize the one-time-password entered by the user to verify the identity of the user trying to access the secure firearm, thereby enabling the multi-factor authentication.

The controller 308 may send an API request, via APIs 312, to the server 320 for verifying the identity of the user trying to access the secure firearm 300. Further, the security module 314 may also perform verification of the user and the secure firearm. The security module 314 may verify user identity against the centralized database 315 of authorized users 316. The security module 314 may also check the status of the secure firearm 300, including ownership, legal compliance, or any reported loss or theft. The security module 314 may also authenticate the communication of the secure firearm 300 to the server 320.

In an aspect of the present invention, the secure firearm 300 may also comprise a GPS capability (not shown in the figure). The GPS capability may allow the controller 308 to determine a precise location of the secure firearm 300. The GPS enabled secure firearm 300 may also be remotely locked or disabled via a connected device or a central monitoring system. Further, in case a number of unauthorized or unsuccessful attempts to access the secure firearm 300 is above a threshold, the GPS capability may be utilized to send the location of the secure firearm 300 to emergency services, via the security module 314.

Based on verification of the identity of the user, the server 320 may send a response to the electronic identification module 310 via the APIs 312. If the user is an authorized user, the server 320 may indicate the electronic identification module 310 to unlock the secure firearm via the locking mechanism 325. Further, the controller 308 in the electronic identification module 310 may also be configured to record access events, send alerts, or update the database 315. The database 315 may be similar in configuration and functioning to the database 215 (as described above in detail in relation to FIG. 3).

Figure 4:
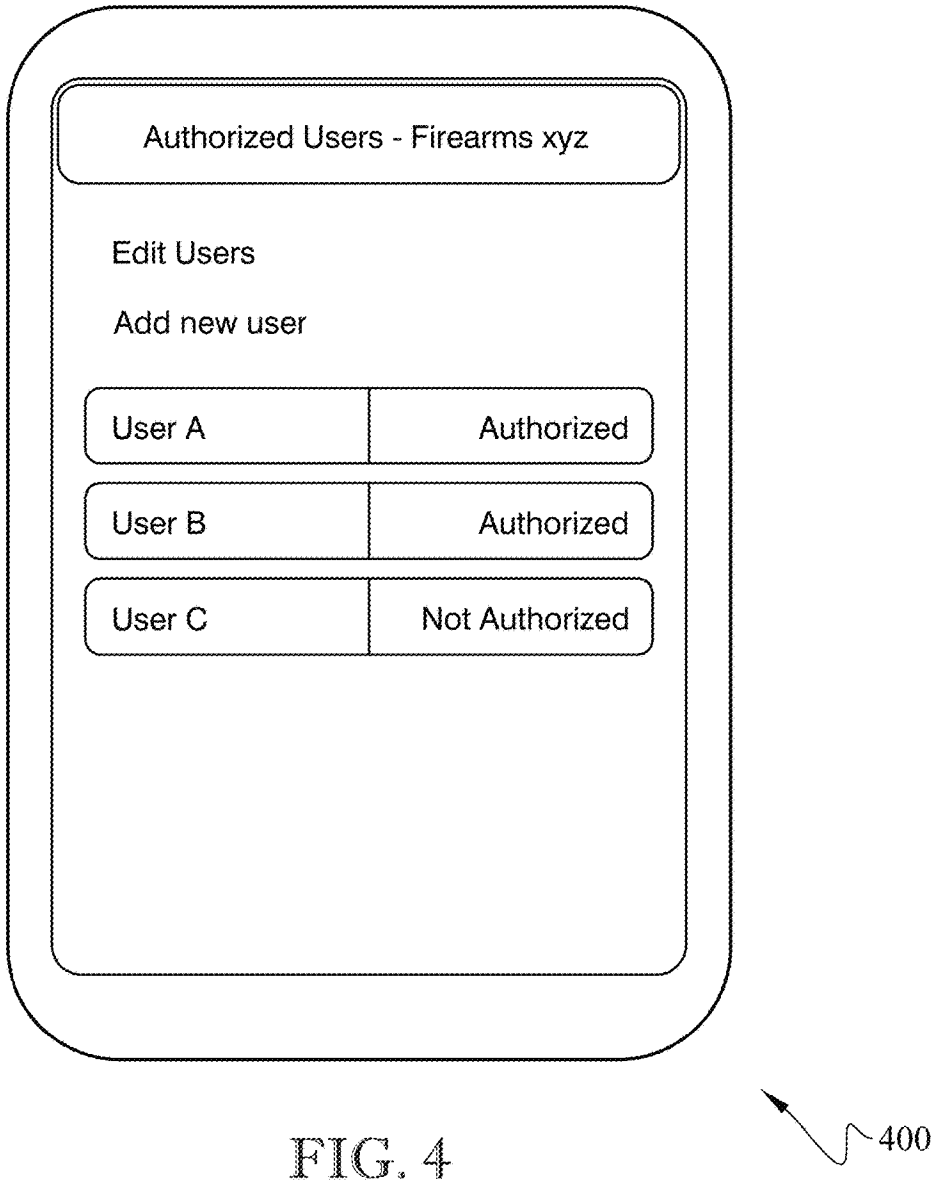
FIG. 4 shows an interface on a user device associated with a user for controlling access to the secure firearm by authorized users, in accordance with some embodiments of the present disclosure.

FIG. 4 shows an interface 400 on a user device associated with a user for controlling access to the secure firearm by authorized users, in accordance with some embodiments of the present disclosure. The interface 400 may be a user interface on the user device associated with the user. One or more users may be authorized to access the secure firearm. The authorization of the one or more users with respect to the secure firearm may be updated via the interface 400. For example, one or more new users may be added to a list of one or more authorized users, or the authorization of the one or more authorized users may be removed, updated, or edited via the interface 400.

The interface 400 may comprise a login screen where an authorized user of the one or more authorized users may login by entering user credentials. The authorized user having the ability to control authorization of the one or more users may be an admin. The user credentials may comprise a username, a passcode, a biometric or other secure authentication methods like one-time-password based login. After successful login, the authorized user or the admin may be presented with a dashboard that may provide an overview of status of the one or more authorized users to access the secure firearm. Further, the one or more authorized users may also access one or more secure firearms by registering and later on entering appropriate user credentials, passcode, or biometric attributes into a database associated with the one or more secure firearms.

The authorized user or the admin may select a secure firearm from the one or more secure firearms via the dashboard to manage the access and settings of the selected secure firearm. The authorized user may add, remove, or edit the authorization of the one or more users associated with the one or more secure firearms via the interface 400. The one or more authorized users for the selected firearm may be added by registering biometric attributes of the one or more users, assigning passcodes, and setting user privileges. Also, the access controls for the one or more authorized users may also be set via the interface 400. The access controls may specify when and how the one or more authorized users may access the secure firearm. The access controls may comprise time restrictions or location-based access restrictions.

As shown in FIG. 4, user A and user B are authorized users to access a secure firearm xyz, whereas a user C is not authorized to access the secure firearm xyz. The authorization of the users A, B, or C associated with the secure firearm xyz may be edited by the authorized user of the admin. Further, new users may also be added to the authorized users to access the secure firearm xyz via the interface 400.

Further, the interface 400 may also provide the ability to remotely lock or unlock the one or more secure firearms. The authorized user or the admin may also view access logs comprising details of when and by whom the one or more secure firearms were accessed. Notifications or alerts may also be sent to the user device associated with the authorized user upon an unauthorized access attempt, or when the passcode, or the biometric attribute of a user trying to access the secure firearm do not match with the data stored in the database.

The authorized user may also configure security and privacy settings for the one or more firearms, comprising password changes or privacy preferences. The interface 400 may also comprise a logout option to securely terminate the session when the authorized user has finished managing the access settings of the one or more secure firearms.

Figure 5:
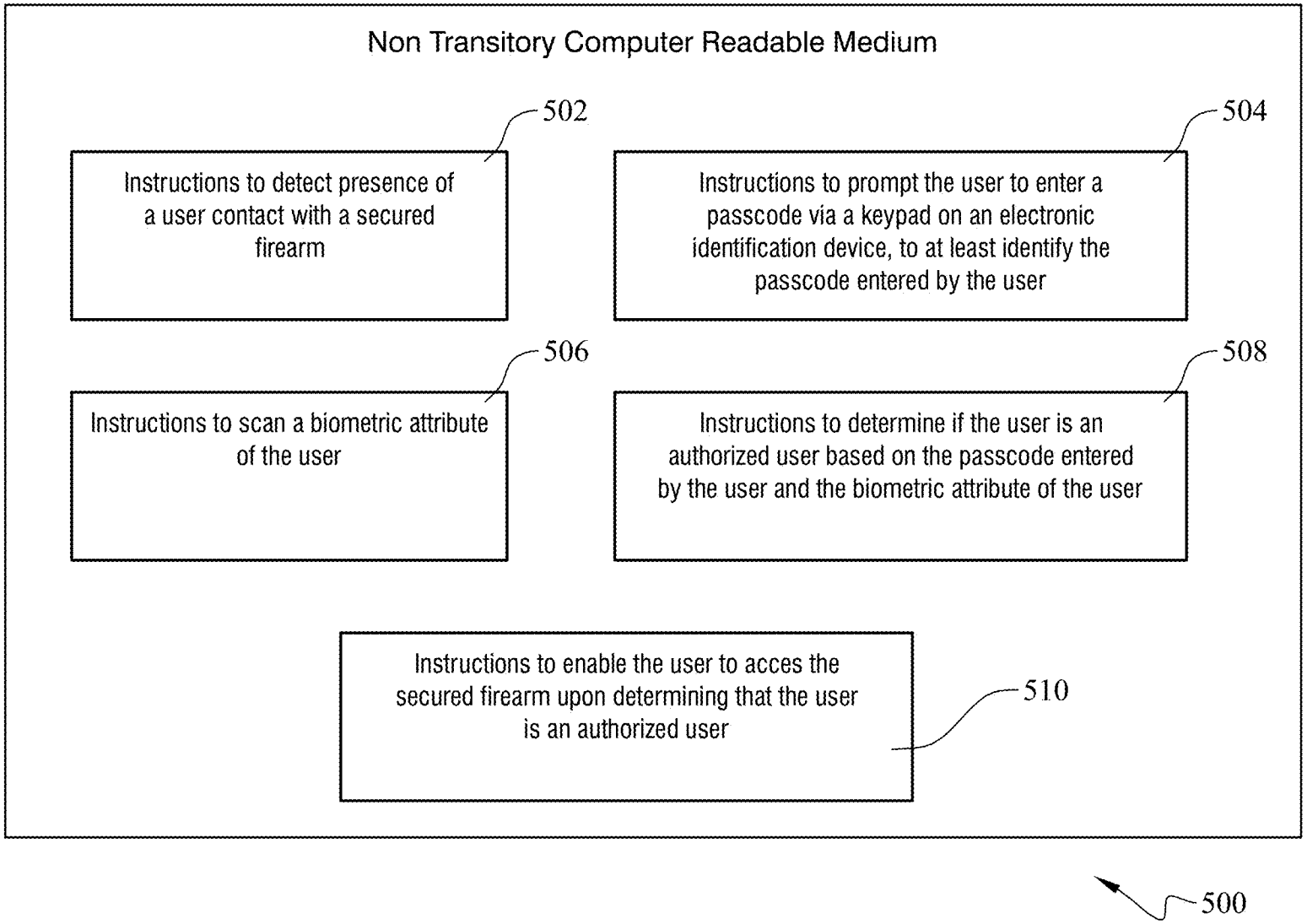
FIG. 5 shows a non-transitory computer readable medium comprising instructions executable by a processor to perform or control performance of operations of an example method of the present disclosure.

FIG. 5 illustrates a non-transitory computer readable medium 500 comprising instructions executable by the processor 328 in the controller 308 (as shown in FIG. 3) to perform or control performance of operations of the present disclosure. The controller 308 may also comprise the memory 330 to store the instructions to be executed by the processor 328. The instructions may comprise instructions to cause the processor to perform or control performance of operations of the example method 100. The instructions may comprise instructions 502 to detect presence of a user contact with a secure firearm. The instructions may comprise instructions 504 to prompt the user to enter a passcode via a keypad on an electronic identification module, to at least identify the passcode entered by the user. The instructions may comprise instructions 506 to scan a biometric attribute of the user. Further, the instructions may comprise instructions 508 to determine if the user is an authorized user based on the passcode entered by the user and the biometric attribute of the user. Furthermore, the instructions may comprise instructions 510 to enable the user to access the secure firearm upon determining that the user is an authorized user.

Figure 6:
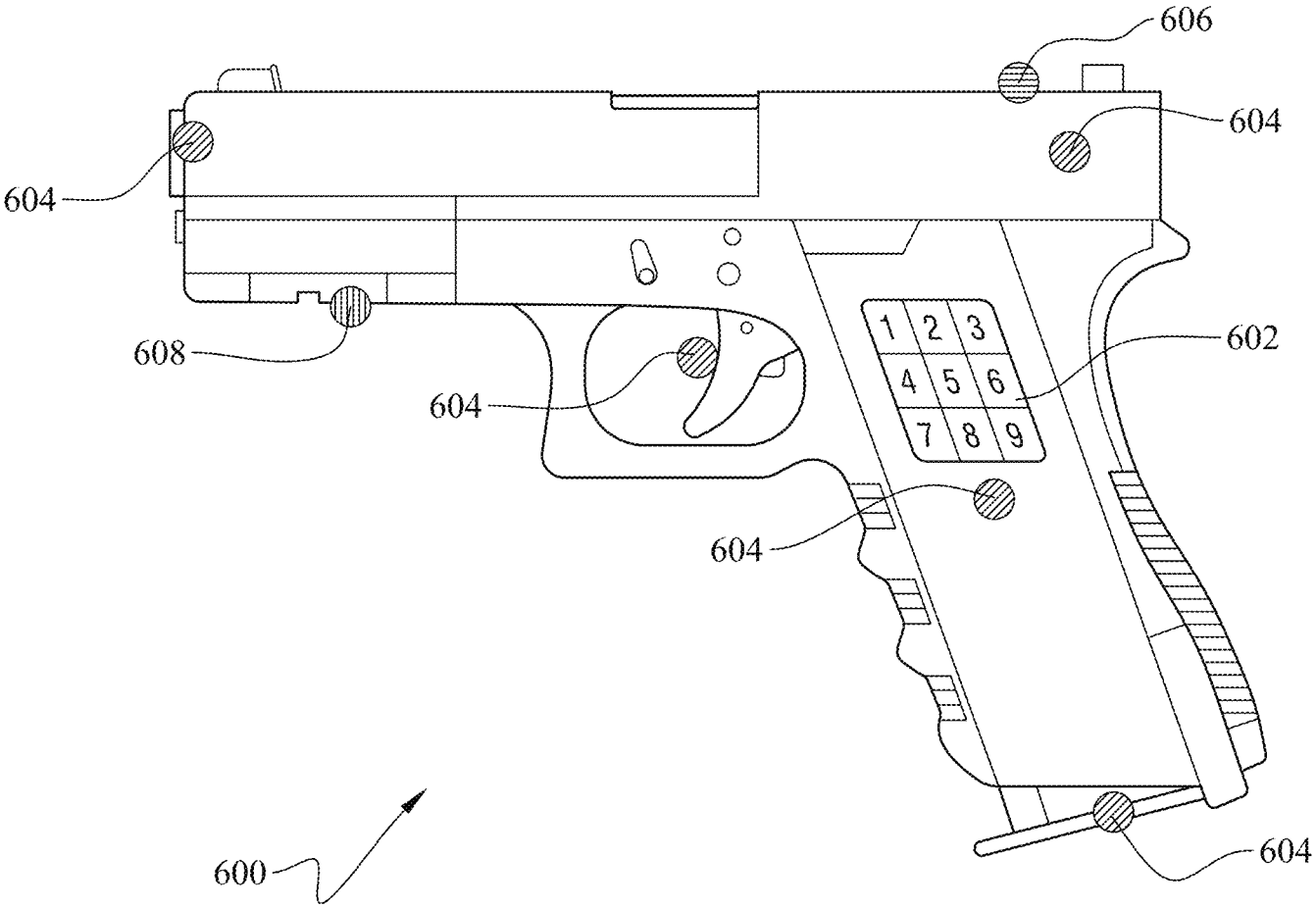
FIG. 6 shows an exemplary secure firearm associated with the methods and systems of the present disclosure, in accordance with some embodiments of the present disclosure.

FIG. 6 shows an exemplary secure firearm 600 associated with the methods and systems of the present disclosure, in accordance with some embodiments of the present disclosure. The secure firearm 600 may comprise advanced safety and access control mechanisms, to be executed by a controller (not shown in the figure, but may be implemented as the controller 204, or 308, as shown in FIG. 2, or FIG. 3) to prevent unauthorized use while ensuring quick and reliable access by one or more authorized users.

The controller in the secure firearm 600 may implement a multi-factor authentication to ensure that only the one or more authorized users may access and operate the secure firearm 600. The multi-factor authentication may comprise scanning of a biometric attribute (fingerprint recognition, palm print readers, face recognition, iris scan, retinal scan, voice recognition, or like) of a user trying to access the secure firearm 600, prompting the user to enter a passcode via a keypad, prompting the user to enter a one-time-password, or a combination of one or more such authentication methods.

The controller in the secure firearm 600 is coupled to one or more biometric sensors 604, positioned at one or more locations on the secure firearm 600. The one or more biometric sensors 604 may comprise a fingerprint scanner, a palm print scanner, a retinal scanner, an iris scanner, a voice recognition, or a face recognition. The one or more biometric sensors 604 may obtain and verify a biometric attribute of the user trying to access the secure firearm 600.

Further, the controller in the secure firearm is also coupled to a keypad 602, to enable the user to enter a passcode to access the secure firearm 600. The controller may allow a manufacturer or a seller of the secure firearm 600 to define specific access control rules to be stored in a database associated with the secure firearm 600. The access control rules may comprise time restrictions for access, location-based restrictions, or defining the identity of the one or more users authorized to access the secure firearm 600.

Moreover, the firearm 600 comprises a laser aimer 606, which speeds up target acquisition, decreasing the time required for the shooter to aim and fire, as well as decreasing the time necessary for follow-up shots. Laser aimer 606 also aid in point shooting, where the shooter relies on hand eye coordination rather than aiming with a traditional sight. The laser aimer 606 can be turned on and off in any suitable manner, for example, by a switch provided at any suitable location on the firearm. Furthermore, the firearm 600 comprises a light source 608. The light source may be a flashlight. The flashlight the flashlight can have any suitable component or characteristic which may allow the light source 608 to provide light while allowing the firearm 600 to shoot a projectile through the light source 608.

Further, the controller may also enable remote management of the secure firearm 600 by connecting to a server associated with the secure firearm 600. In an aspect, the server may be implemented as the controller in the secure firearm 600. The manufacturer or the seller of the secure firearm 600 may also control and monitor the status of the secure firearm 600 via a mobile application installed on a mobile device associated with the manufacturer or the seller of the secure firearm 600, or via a web-based interface. The remote management may enable quick response in emergency situations, as well as the ability to remotely lock or unlock the secure firearm 600. In addition, the controller may also enable tamper detection mechanisms in the secure firearm 600, thereby alerting the manufacturer or the seller of the secure firearm 600 when a number of unsuccessful attempts to access or modify the secure firearm 600 reaching a certain threshold. Also, the controller may enable maintenance of detailed access logs and event records related to the secure firearm 600, thus allowing the manufacturer or the seller of the secure firearm 600 to review the status of the secure firearm 600.

The embodiments of the present invention disclose methods, devices, and systems for facilitating firearms safety via a multi-factor authentication. A secure firearm comprises a biometric sensor, a keypad, and a controller operatively coupled with the biometric sensor, and the keypad. The controller is configured to detect presence of a user contact with the firearm when the firearm is in a locked mode. Upon detecting the presence of the user contact with the firearm, the user is prompted to enter a passcode via the keypad. The passcode entered by the user is identified. A biometric attribute of the user is obtained from the biometric sensor. It is determined if the user is an authorized user based on the passcode entered by the user and the biometric attribute of the user. In response to determining that the user is an authorized user, the firearm is unlocked.

The methods described herein may be performed using the systems described herein. In addition, it is contemplated that the methods described herein may be performed using systems different than the systems described herein. Moreover, the systems described herein may perform the methods described herein and may perform or execute the instructions stored in the CRSMs described herein. It is also contemplated that the systems described herein may perform functions or execute instructions other than those described in relation to the methods and CRSMs described herein.

Furthermore, the CRSMs described herein may store instructions corresponding to the methods described herein, and may store instructions which may be performed or executed by the systems described herein. Furthermore, it is contemplated that the CRSMs described herein may store instructions different than those corresponding to the methods described herein, and may store instructions which may be performed by systems other than the systems described herein. The methods, systems, and CRSMs described herein may include the features or perform the functions described herein in association with any one or more of the other methods, systems, and CRSMs described herein.

In some embodiments the method or methods described above may be executed or carried out by a computing system including a tangible computer-readable storage medium, also described herein as a storage machine, that holds machine-readable instructions executable by a logic machine (i.e., a processor or programmable control device) to provide, implement, perform, and/or enact the above-described methods, processes and/or tasks. The computing system may include a display subsystem to display a graphical user interface (GUI), or any visual element of the methods or processes described above. The computing system may include an input subsystem that receives user input. A communication subsystem may allow the methods described above to be executed or provided over a computer network. For example, the communication subsystem may be configured to enable the computing system to communicate with a plurality of personal computing devices. The communication subsystem may include wired and/or wireless communication devices to facilitate networked communication. The described methods or processes may be executed, provided, or implemented for a user or one or more computing devices via a computer-program product such as via an application programming interface (API).

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A method for facilitating firearms safety via a multi-factor authentication, the method comprising:

detecting, by an electronic identification module positioned on a secure firearm, presence of a user contact with the secure firearm;

upon detecting the presence of the user contact with the secure firearm, prompting a user, by the electronic identification module, to enter a passcode via a keypad on the secure firearm, to at least identify the passcode entered by the user;

obtaining, by the electronic identification module, a biometric attribute of the user via a biometric sensor on the secure firearm;

determining, by the electronic identification module, if the user is an authorized user based on the passcode entered by the user and the biometric attribute of the user; and in response to determining that the user is the authorized user enabling the user to access the secure firearm, wherein accessing the secure firearm enables the user to fire ammunition from the firearm.

2. The method of claim 1, wherein the electronic identification module comprises a controller operatively coupled to the biometric sensor and the keypad.

3. The method of claim 1, wherein the biometric sensor is implemented as a biometric reader, or a biometric detector.

4. The method of claim 1, wherein the electronic identification module is positioned on at least one of: a body of the secure firearm, a handle of the secure firearm, a grip of the secure firearm, a top of a stock above the grip of the secure firearm, a trigger of the secure firearm, a barrel of the secure firearm, or a magazine housing of the secure firearm.

5. The method of claim 1, wherein the biometric attribute of the user comprises a fingerprint, a palm print, a retinal scan, an iris scan, a voice recognition, or a face recognition.

6. The method of claim 1, further comprising:

registering, by the electronic identification module, the biometric attributes of one or more users in a database, wherein the registering enables the one or more users to be authorized users to access the secure firearm.

7. The method of claim 1, further comprising:

storing, by the electronic identification module, the biometric attributes of the one or more users in a database.

8. The method of claim 1, further comprising:

in response to determining that the user is not the authorized user, blocking the user to access the secure firearm, wherein blocking the user to access the secure firearm prevents the user to fire ammunition from the firearm.

9. A secure firearm, comprising:

a biometric sensor;

a keypad; and a controller operatively coupled with the biometric sensor, and the keypad, the controller being configured to:

detect presence of a user contact with the secure firearm, the secure firearm being in a locked mode;

upon detecting the presence of the user contact with the secure firearm:

prompt a user to enter a passcode via the keypad;

identify the passcode entered by the user;

obtain, from the biometric sensor, a biometric attribute of the user;

determine, based on the passcode entered by the user and the biometric attribute of the user, if the user is an authorized user; and in response to determining that the user is the authorized user, unlocking the secure firearm.

10. The secure firearm of claim 9, wherein the controller is further configured to: determine if the passcode entered by the user, is a valid passcode; and activate the biometric sensor to obtain the biometric attribute of the user, in response to a determination that the passcode entered by the user is the valid passcode.

11. The secure firearm of claim 9, wherein the controller is further configured to: determine if the biometric attribute of the user matches a biometric attribute of one or more authorized users, and in response to determining that the biometric attribute of the user matches with the biometric attribute of the one or more authorized users, prompt the user to enter the passcode.

12. The secure firearm of claim 9, wherein the biometric sensor is implemented as a biometric reader, or a biometric detector.

13. The secure firearm of claim 9, further comprising a contact sensor.

14. The secure firearm of claim 13, wherein the contact sensor is positioned on a grip, a trigger, a trigger guard, or a handle of secure firearm.

15. The secure firearm of claim 9, wherein the biometric attribute of the user comprises a fingerprint, a palm print, a retinal scan, an iris scan, a voice recognition, or a face recognition.

16. The secure firearm of claim 9, wherein the controller is further configured to register the biometric attributes of one or more users in a database, and wherein the registration enables the one or more users to be authorized users to access the secure firearm.

17. The secure firearm of claim 9, wherein the controller is further configured to:

in response to determining that the user is not the authorized user, block the user to access the secure firearm, wherein blocking the user to access the secure firearm prevents the user to fire ammunition from the firearm.

18. A method for facilitating firearms safety via a multi-factor authentication, the method comprising:

detecting, by an electronic identification module positioned on a secure firearm, presence of a user contact with the secure firearm;

upon detecting the presence of the user contact with the secure firearm, prompting a user, by the electronic identification module, to enter a passcode via a keypad on the secure firearm, to at least identify the passcode entered by the user;

obtaining, by the electronic identification module, a biometric attribute of the user via a biometric sensor on the secure firearm;

obtaining, by the electronic identification module, a one-time password entered by the user on a user device;

determining, by the electronic identification module, if the user is an authorized user based on the passcode entered by the user, the biometric attribute of the user, and the one-time password entered by the user; and in response to determining that the user is the authorized user enabling the user to access the secure firearm, wherein accessing the secure firearm enables the user to fire ammunition from the firearm.

19. The method of claim 18, wherein detecting presence of the user contact comprises detecting, via a contact sensor, positioned on the secure firearm.

20. The method of claim 18, wherein the one-time password is entered by the user via a mobile application.

* * * * *